US007708588B2

(12) United States Patent
Chen

(10) Patent No.: US 7,708,588 B2
(45) Date of Patent: May 4, 2010

(54) ELECTRICAL CONNECTOR

(75) Inventor: Hsin-Ta Chen, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 10 days.

(21) Appl. No.: 12/236,378

(22) Filed: Sep. 23, 2008

(65) Prior Publication Data

US 2010/0075515 A1 Mar. 25, 2010

(51) Int. Cl.
*H01R 12/24* (2006.01)

(52) U.S. Cl. ..... 439/492

(58) Field of Classification Search ..... 439/492, 439/495, 493, 77, 67

See application file for complete search history.

(56) References Cited

U.S. PATENT DOCUMENTS 5,871,369 A * 2/1999 Obayashi et al. ..... 439/495
6,030,246 A * 2/2000 Kunishi ..... 439/329
7,025,625 B2 * 4/2006 Kai ..... 439/495

* cited by examiner

*Primary Examiner*—T C Patel
*Assistant Examiner*—Phuong Nguyen
(74) *Attorney, Agent, or Firm*—WPAT, P.C.; Anthony King

(57) ABSTRACT

An electrical connector capable of being connected with a FPCB and a PCB stably, includes an insulating housing defining a receiving space at a top portion thereof. A plurality of terminals is received in the insulating housing and each terminal has a contacting portion projecting into the receiving space for being connected with the FPCB. A reinforcement board is received in the receiving space for being fastened together with the FPCB. A slide cover slidably covers on the insulating housing and presses against the reinforcement board. When the electrical connector is soldered to the PCB, the FPCB is electrically connected with the PCB stably for the slider cover pressing against the reinforcement board to make the FPCB connected with the terminals steadily.

2 Claims, 4 Drawing Sheets

ELECTRICAL CONNECTOR

BACKGROUND OF THE INVENTION

1. Field of the Invention

The present invention relates to an electrical connector, and more particularly to an electrical connector capable of being connected with a flexible printed circuit board and a printed circuit board stably.

2. The Related Art

In general, two methods are known to obtain an electrical connection between a printed circuit board (PCB) and a flexible printed circuit board (FPCB). One is employing a receptacle connector electrically connected to a plug connector. The receptacle connector is mounted on the PCB (or FPCB) and the plug connector is connected to the FPCB (or PCB). The electrical connection between the PCB and the FPCB is achieved when the receptacle connector is mated with the plug connector. The other one is forming a folding cover at a conventional electrical connector mounted on the PCB for keeping the FPCB in the conventional electrical connector to obtain the electrical connection between the PCB and the FPCB.

However, disadvantages of the above-mentioned manners are exposed. The former connection structure is complex and the latter causes the conventional electrical connector to occupy much space when the folding cover is unfolded. Moreover, the plug connector would likely depart from the receptacle connector when the assembly thereof suffers an outside force to bring about a disconnection between the PCB and the FPCB, also the folding cover is easily opened which results in a same consequence if the conventional electrical connector suffers a force from outside.

SUMMARY OF THE INVENTION

It is an object of the present invention to provide an electrical connector capable of being connected with a FPCB and a PCB stably, and the electrical connector has simple structure and reduced height. In order to achieve this object, the electrical connector includes an insulating housing and a plurality of terminals received in the insulating housing. The insulating housing has a receiving space at a top portion thereof and each terminal has a contacting portion projecting into the receiving space for being connected with the FPCB. A reinforcement board is received in the receiving space for being fastened together with the FPCB. A slide cover slidably covers on the insulating housing and presses against the reinforcement board. When the electrical connector is soldered to the PCB, the FPCB is electrically connected with the PCB stably because of the slide cover pressing against reinforcement board to make FPCB connected with the contacting portions of the terminals steadily.

As described above, by the reinforcement board being fastened together with the FPCB and the slide cover pressing against the reinforcement board to make the FPCB connected with the contacting portions of the terminals stably, then the PCB can be electrically connected with the FPCB steadily by the terminals. Moreover, the FPCB is disposed between the insulating housing and the slide cover, so the total height thereof is not increased.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
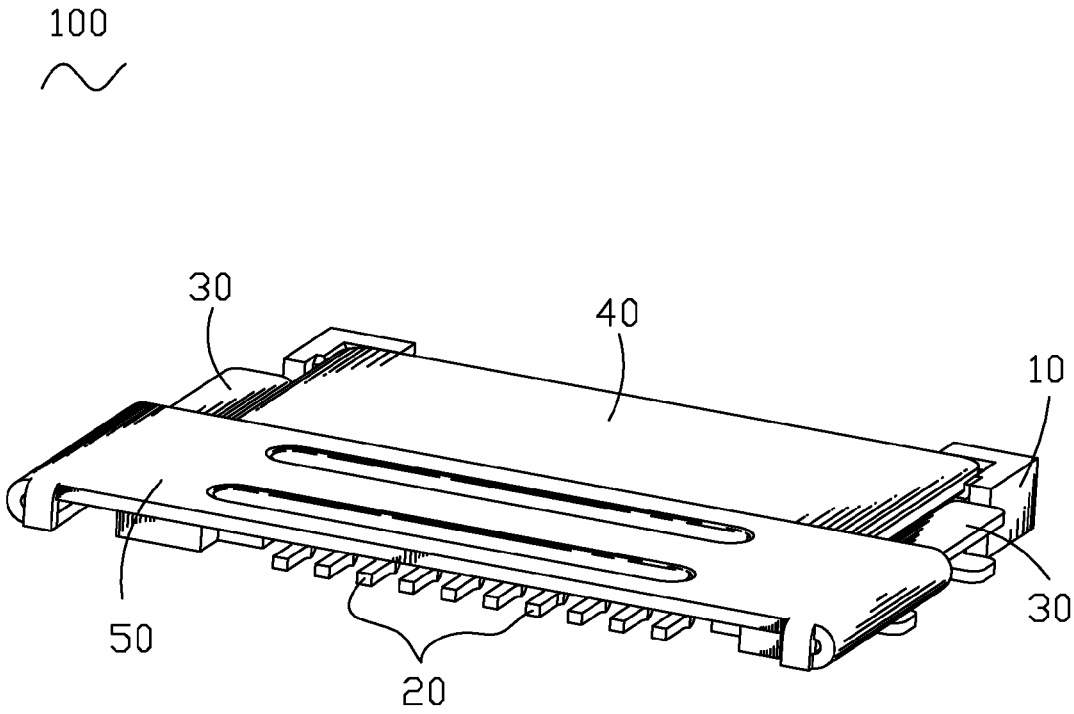
FIG. 1 is an assembly perspective view of an electrical connector in accordance with the present invention.
Figure 2:
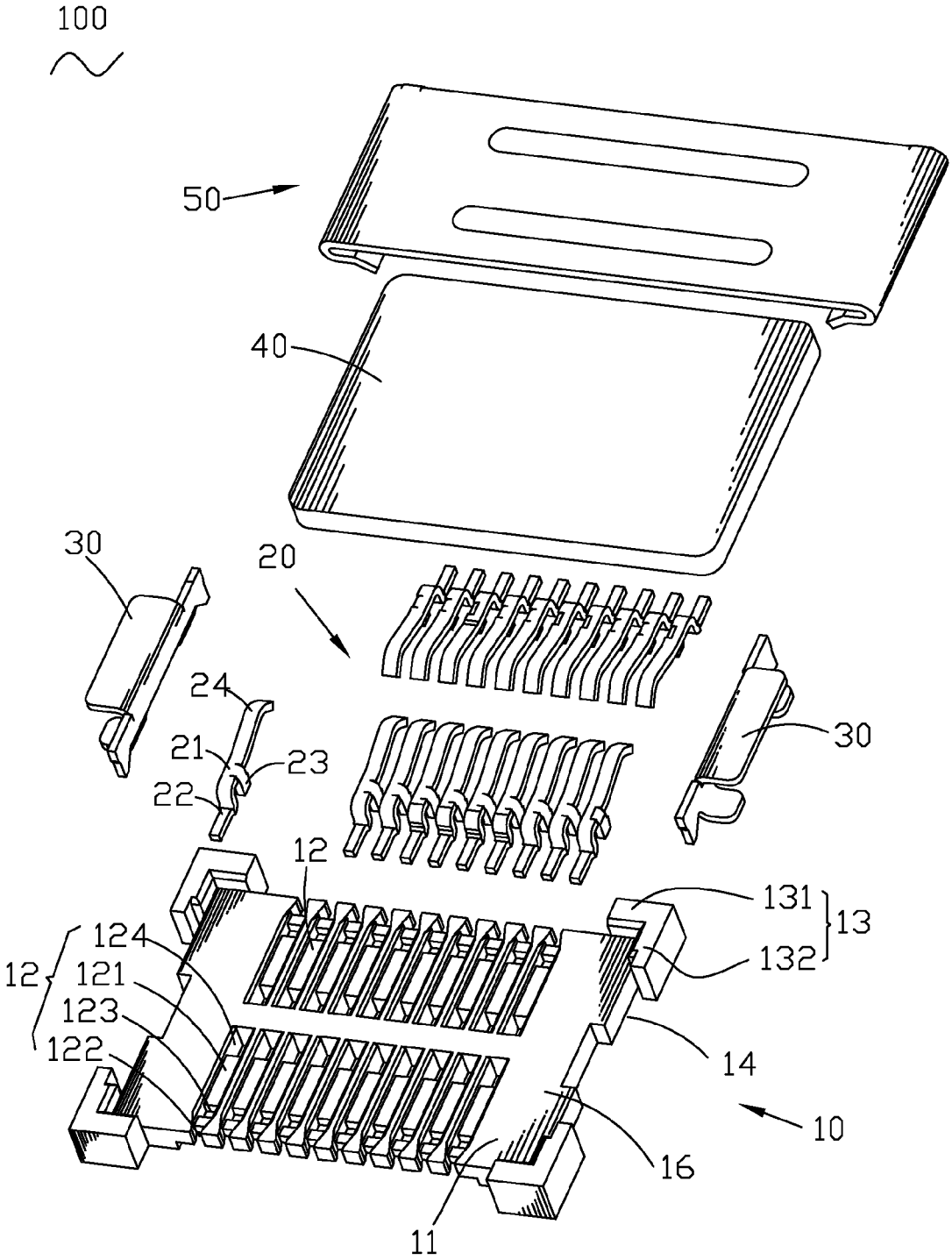
FIG. 2 is an exploded view of the electrical connector.
Figure 3:
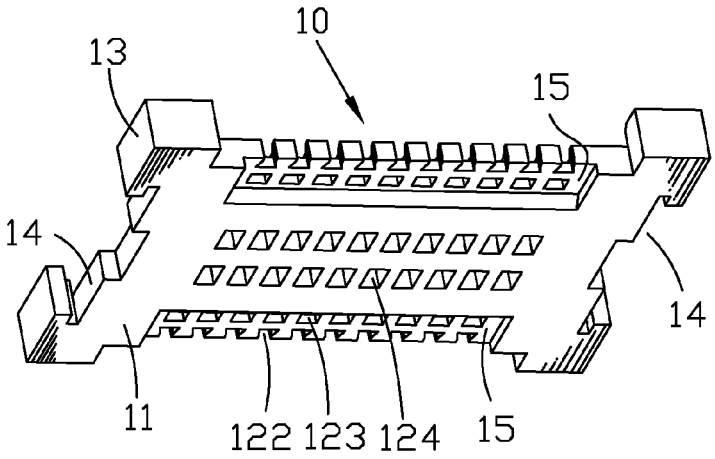
FIG. 3 is a perspective view showing an insulating housing of the electrical connector.
Figure 4:
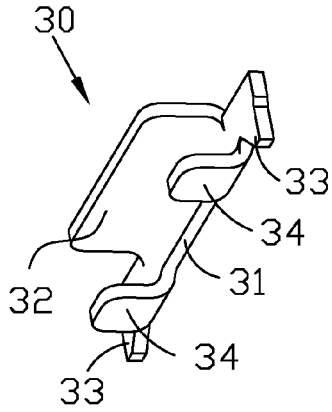
FIG. 4 is a perspective view showing a guiding member of the electrical connector.
Figure 5:
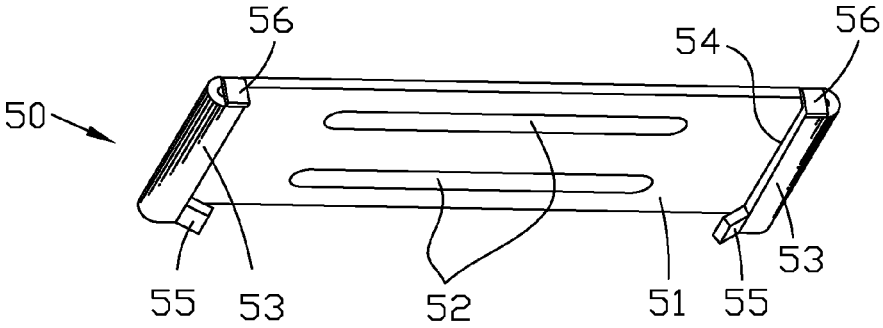
FIG. 5 is a perspective view of a slide cover of the electrical connector.

With reference to FIG. 1 and FIG. 2, an electrical connector 100 according to the invention is shown. The electrical connector 100 includes an insulating housing 10, a plurality of terminals 20, a pair of guiding members 30, a reinforcement board 40 and a slide cover 50.

Please refer to FIGS. 2 to 5. The insulating housing 10 has a substantially flat basic body 11. The basic body 11 defines two groups of terminal grooves 12 symmetrically disposed at a top surface thereof. A bottom surface of the basic body 11 defines two welding recesses 15 at two opposite edges thereof respectively. Each of the terminal grooves 12 has an engaging trough 121. One end of the engaging trough 121 defines an opening 122 and a through hole 123 depart from each other and communicating with the lateral recess 15, and the other end of the engaging trough 121 defines a containing hole 124 penetrating through the basic body 11.

Four retaining projections 13 extend upward along the outsides of four corners of the basic body 11 respectively and are higher than the top surface of the basic body 11, so that the four retaining projections 13 and the top surface of the basic body 11 collectively define a receiving space 16 therebetween for receiving the reinforcement board 40 therein. Each of the retaining projections 13 includes a transverse portion 131 and a longitudinal portion 132 connected to one end of the transverse portion 131 to make the retaining projection 13 have a substantially L-shaped structure. A fixing trough 14 for receiving a guiding member 30 is formed between one side of the basic body 11 and two corresponding longitudinal portions 132 because a space exists between end portions of the longitudinal portions 132 and the basic body 11.

Each of the terminals 20 has a base portion 21, a welding tail 22, a soldering portion 23 and a contacting portion 24. The welding tail 22 extends downward and then extends forward from a front end of the base portion 21 and the contacting portion 24 extends rearward from a rear end of the base portion 21. A free end of the contacting portion 24 bends downward slightly. The soldering portion 23 extends downward from a right side of the base portion 21.

The pair of guiding members 30 is made of metal, and each of the guiding members 30 has a substantially rectangular main portion 31. The main portion 31 has a guiding portion 32 extending sideward from a top thereof. Two ends of the main portion 31 protrude downward to form two supporting nails 33. Adjacent to the supporting nails 33, the guiding member 30 defines two connecting portions 34 extending sideward from a bottom of the main portion 31 and towards the same side as the guiding portion 32.

The slide cover 50 is made of metal and has a substantially flat base board 51. Two transversely parallel pressing ribs 52 are shaped from the base board 51 and projecting out of the bottom of the base board 51. Opposite sides of the base board 51 curl downward and then extend towards each other to form a bending portion 53 respectively, and a sliding passageway 54 is formed between the base board 51 and the bending portion 53. A front end of a free edge of the bending portion 53 extends and bends downward to form a withstanding portion 55. The base board 51 defines a pair of limitative slices 56 at a rear end thereof and adjacent to two opposite sides of the base board 51.

In assembly, the plurality of terminals 20 are divided into two groups and received in the corresponding terminal grooves 12 symmetrically. The base portions 21 are located in the engaging troughs 121. The welding tails 22 and the soldering portions 23 pass through the openings 122 and the through holes 123 and extend into the welding recesses 15 for being soldered to a PCB (not shown). The contacting portions 24 project out of the engaging troughs 121. The pair of guiding members 30 is disposed at opposite sides of the base body 11 with the two ends of the main portion 31 are tightly against the two sides of the fixing trough 14. The slide cover 50 is slidably assembled to the guiding members 30. The guiding portions 32 are retained in the sliding passageways 54, and the slide cover 50 can slide along the guiding portions 32. The limitative slices 56 are positioned at the outsides of the retaining projections 13 to protect the slide cover 50 from moving.

When the electrical connector 100 is mounted on the PCB, both the welding tails 22 and the soldering portions 23 are soldered to the PCB. In this case, each terminal 20 has two portions soldered with the PCB, which ensures the electrical connection between the terminals 20 and the PCB more stable. The supporting nails 33 of the guiding members 30 are fixed on the PCB. The connecting portions 34 are electrically connected to ground wires which are formed on the PCB for shielding an EMI between the electrical connector 100 and the PCB.

Figure 6:
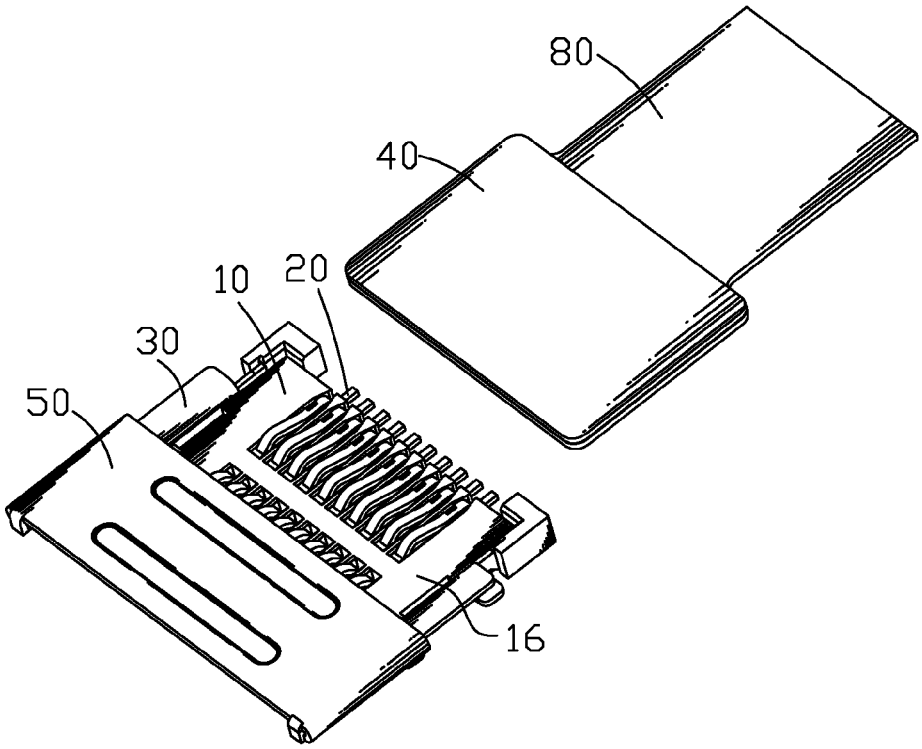
FIG. 6 is a perspective view of the electrical connector and a flexible printed circuit board, showing a state that a reinforcement board of the electrical connector is fastened together with the flexible printed circuit but not assembled to the insulating housing of the electrical connector.
Figure 7:
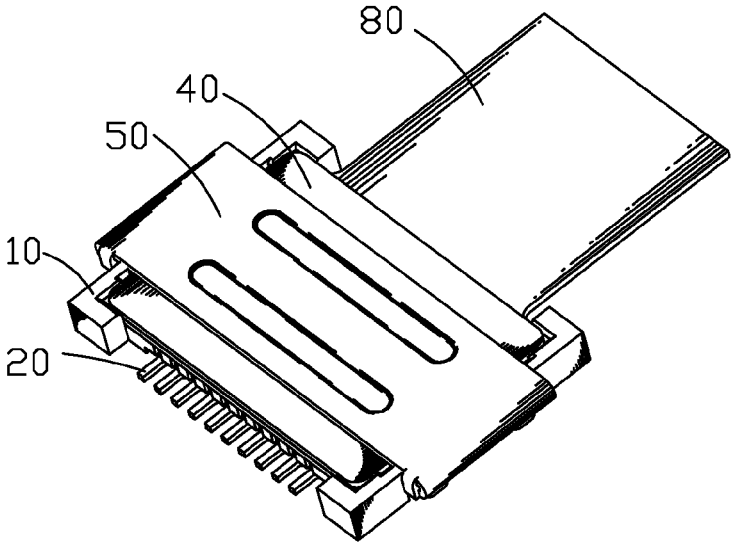
FIG. 7 is an assembly view showing the flexible printed circuit board has been assembled to the electrical connector.

Refer to FIGS. 6 and 7, a flexile printed circuit board (FPCB) 80 adapted for being connected to the electrical connector 100 which is mounted to the above-mentioned PCB is shown. One end of the FPCB 80 is fastened together with the reinforcement board 40 before assembled to the electrical connector 100. In assembly, firstly, pull the slide cover 50 back until the withstanding portions 55 are stopped by two longitudinal portions 132 which are placed at a rear portion of the insulating housing 10. Then, put the reinforcement board 40 in the receiving space 16 and push the slide cover 50 forward until the withstanding portions 55 are blocked by two longitudinal portions 132 which are positioned at a front portion of the insulating housing 10. In this case, the pressing ribs 52 of the slide cover 50 provide a pressing force to the reinforcement board 40, and the FPCB 80 is electrically connected with the contacting portions 24 of the terminals 20 stably. Meanwhile, the free ends of the contacting portions 24 are inserted into the containing holes 124 because of the pressure from the pressing ribs 52. With the slide cover 50 pressing against the reinforcement board 40 strongly, the reinforcement board 40 can not easily be released out of the receiving space 16 of insulating housing 10. Even if the electrical connector 100 suffers an outside force and makes the slide cover 50 moving, because of the corporation of the withstanding portions 55 and the longitudinal portions 132, the slide cover 50 can not slip out of the insulating housing 10. One of the pressing ribs 52 still can supply a pressing force to the reinforcement board 40. Thus, the FPCB 80 is stably electrically connected with the PCB by the reinforcement board 40 being fastened together with the FPCB 80 and the slide cover 50 pressing against the reinforcement board 40.

As the above description, by the reinforcement board 40 being fastened together with the FPCB 80 and the slide cover 50 pressing against the reinforcement 40 to make the FPCB 80 stably connect with the contacting portions 24 of the terminals 20, then the PCB can be electrically connected with the FPCB 80 steadily. Moreover, the FPC 80 is disposed between the insulating housing 10 and the slide cover 50, so the total height thereof is not increased.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector for being electrically connected with a flexible printed circuit board, comprising:

an insulating housing defining a receiving space at a top portion thereof;

a plurality of terminals received in the insulating housing, each of the terminals having a contacting portion projecting into the receiving space for being connected with the flexible printed circuit board;

a reinforcement board received in the receiving space for being fastened together with the flexible print circuit board; and a slide cover slidably covered on the insulating housing for pressing against the reinforcement board;

wherein the electrical connector further comprises a pair of guiding members disposed at two opposite sides of the insulating housing respectively, the slide cover is slidably assembled to the guiding members;

wherein two opposite sides of the slide cover define a sliding passageway respectively, each guiding member has a guiding portion retained in the sliding passageway;

wherein the slide cover has a base board, two opposite sides of the base board curl downward and extend towards each other to form a bending portion respectively, the sliding passageway is formed between the base board and the bending portion;

wherein a free edge of each bending portion extends and bends downward to form a withstanding portion at a portion adjacent to one end thereof, the insulating housing has a basic body and four retaining projections respectively disposed at four corners of the basic body and higher than a top surface of the basic body, the top surface of the basic body and the four retaining projections collectively define the receiving space therebetween, the withstanding portions are stopped by the corresponding two retaining projections when the slide cover slides along the guiding portions of the guiding members.

2. The electrical connector as claimed in claim 1, wherein the base board of the slide cover defines two limitative slices at one lateral side thereof and adjacent to opposite sides of the base board, the two limitative slices are disposed at outsides of the retaining projections to limit the horizontal movement of the slide cover.

* * * * *